US005967665A

United States Patent [19]

MacDonald et al.

[11] Patent Number: 5,967,665

[45] Date of Patent: Oct. 19, 1999

[54] FLEXIBLE POLYMER PACKAGING BAG WITH EASY-OPEN END SEAL FEATURE

[75] Inventors: Gregory Allen MacDonald; Thomas Michael Lager, both of Neenah; Michael Andrew Machurick; Jesse Paul Sorenson, both of Little Chute, all of Wis.

[73] Assignee: Kimberly-Clark Worldwide, Inc., Neenah, Wis.

[21] Appl. No.: 09/251,685

[22] Filed: Feb. 17, 1999

Related U.S. Application Data

[63] Continuation of application No. 08/985,434, Dec. 4, 1997.

[51] Int. Cl.[6] ..... B65D 33/00; B65D 33/04

[52] U.S. Cl. ..... 383/207; 383/66; 383/106; 206/494

[58] Field of Search ..... 383/207, 208, 383/209, 66, 106; 229/87.05, 87.06; 206/494

[56] References Cited

U.S. PATENT DOCUMENTS

| | | | |
|---|---|---|---|
| 2,189,431 | 2/1940 | Moore . | |
| 3,038,651 | 6/1962 | Cloudsley . | |
| 3,641,732 | 2/1972 | Fujio | 229/87.05 X |
| 4,696,050 | 9/1987 | Sengewald | 383/106 X |
| 5,175,011 | 12/1992 | Courvoisier et al. | 383/209 X |
| 5,184,771 | 2/1993 | Jud et al. | 229/87.05 |
| 5,464,285 | 11/1995 | Anderson | 383/207 X |
| 5,655,843 | 8/1997 | Conrad et al. . | |
| 5,666,445 | 9/1997 | Conrad et al. . | |

FOREIGN PATENT DOCUMENTS

| | | | |
|---|---|---|---|
| 3907291 | 9/1990 | Germany | 383/106 |
| WO 93/16929 A1 | 9/1993 | WIPO . | |

*Primary Examiner*—Jes F. Pascua

*Attorney, Agent, or Firm*—Thomas M. Gage; Douglas L. Miller

[57] ABSTRACT

A flexible polymer packaging bag is provided with an easy-open end seal feature for easily tearing through a fused seal. The bag has a pair of side walls, a pair of end walls, a top wall, and a bottom wall, in which the walls form an interior space. A stack of articles are contained in the interior space. A seal is in one of the walls and includes at least one seal area and at least one weakened zone. A frangible line for opening the bag is in the one wall and intersects the seal at the weakened zone, so that the frangible line can be easily tom where it intersects the seal.

7 Claims, 4 Drawing Sheets

FLEXIBLE POLYMER PACKAGING BAG WITH EASY-OPEN END SEAL FEATURE

This application is a continuation of application Ser. No. 08/985,434 entitled FLEXIBLE POLYMER PACKAGING BAG WITH EASY-OPEN END SEAL FEATURE and filed in the U.S. Patent and Trademark Office on Dec. 4, 1997, and currently pending. The entirety of application Ser. No. 08/985,434 is hereby incorporated by reference.

BACKGROUND OF THE INVENTION

The present invention relates to flexible packaging bags for containing and dispensing articles, More particularly, the present invention relates to a flexible packaging bag having an easy-open end seal feature that permits the bag to be easily opened at a seal for dispensing the articles therefrom.

Packaging bags composed of flexible polymer materials have been used for packaging various types of articles, such as infant diapers, child training pants, absorbent pants, feminine care products, and adult incontinence garments. These bags allow packaging of the articles to create a carton-like look and a configuration facilitating transportation and display on retail shelves. The bags may include handles to facilitate the carrying of the bags, and include mechanisms for providing an access opening in the bag.

For those bags made of a flexible polymer material, the opening mechanism can prove to be difficult to operate manually, i.e., to tear open easily with the hands, and particularly difficult when it traverses or intersects a seal formed from the polymer material. These seals typically are formed by ultrasonic bonding, heat bonding, or the like, in order to melt the polymer materials together. These seals are relatively very hard and stiff in nature compared to unjoined polymer material. In those instances where the opening some users manually to operate the opening mechanism where it crosses the seal. In other words, the user cannot, or has a difficult time, in separating the seal where it meets the opening mechanism.

There can be numerous reasons for the intersection of the opening mechanism with a seal. One of these reasons is when the manufacturing and packaging, i.e., filling, of the bag with articles requires the articles to be inserted in a particular manner or direction in order to provide a desired orientation of the articles relative to the bag. Another reason is when the articles are inserted through an opening in the bag that will eventually be closed and sealed to form a top wall or top panel and it is desired that the articles be accessed and removed through that top wall or panel.

Other problems occur if the size of the opening is too large. This can result in the bag no longer functioning as a means to desirably store and transport the articles. For example, if the opening is too large, the flexible polymer bag can begin to collapse and lose its form or shape after a number of articles have been removed.

Conversely, if the bag opening is too small, the articles cannot be easily dispensed through the opening due, in part, by the compressive forces exerted against the articles that keeps them tightly packed together. Consequently, if only a small portion of an article is available to the user to grasp and pull from the bag through the opening, the user will have difficulty in removing an article and in some instances may not be able to do so at all.

SUMMARY OF THE INVENTION

In response to the discussed difficulties and problems encountered in the prior art, a flexible polymer packaging bag having an easy-open end seal feature has been discovered.

In one form of the invention, there is provided a packaging bag comprising a pair of side walls, a pair of end walls, a top wall, and a bottom wall. A seal is in one of the walls, and comprises at least one seal area and at least one weakened zone. A frangible line is in the one wall and intersects the seal at the weakened zone, so that the frangible line can be easily torn where it intersects the seal.

In another form of the present invention, there is provided a flexible polymer packaging bag comprising a pair of side walls, a pair of end walls, a top wall, and a bottom wall. The walls form an interior space, and are composed of a polymer material having a selected thickness. A stack of articles are contained in the interior space and have a stack direction, and each one of the articles comprises a front panel, a back panel, and a graphic on one of the panels. A window is in one of the walls and has a periphery that substantially frames at least a portion of the graphic. A seal is in the top wall and comprises a pair of flange members joined together at selected areas to form at least one seal area and at least one void area. A frangible line in the top wall intersects the void area.

In still another form of the present invention, there is provided a packaging bag comprising a pair of side walls, a pair of end walls, a top wall, and a bottom wall, in which the walls form an interior space. A stack of articles are contained in the interior space and have a stack direction. A seal is in one of the walls, and comprises at least one seal area and at least one weakened zone. A frangible line in the one wall intersects the seal at the weakened zone, so that the frangible line can be easily torn where it intersects the seal.

BRIEF DESCRIPTION OF THE DRAWINGS

The above-mentioned and other features of the present invention and the manner of attaining them will become more apparent, and the invention itself will be better understood by reference to the following description of the invention, taken in conjunction with the accompanying drawings wherein.

DESCRIPTION OF A PREFERRED EMBODIMENT

Figure 1:
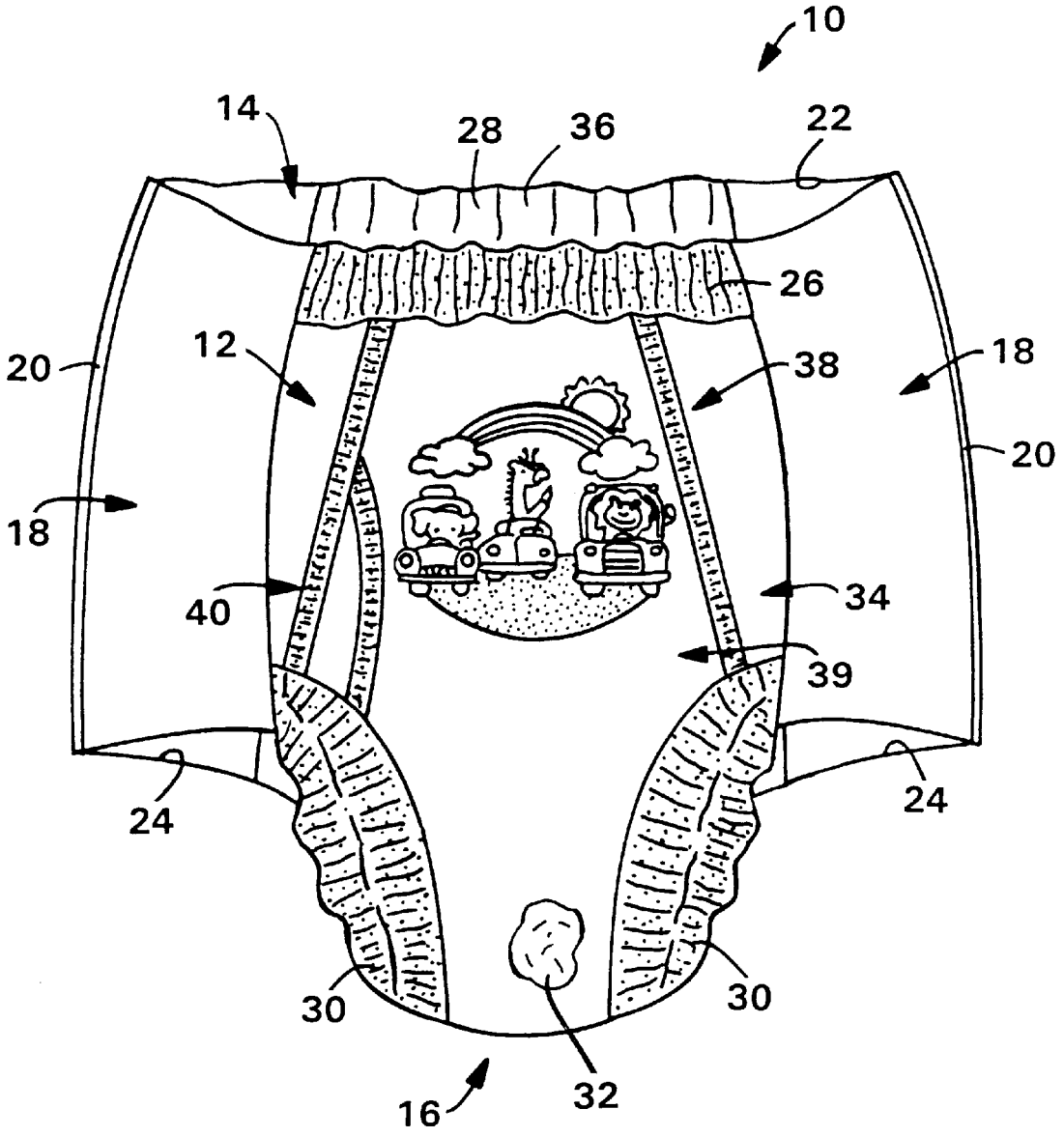
FIG. 1 illustrates a partially broken-away front view of one article having a graphic thereon.
Figure 2:
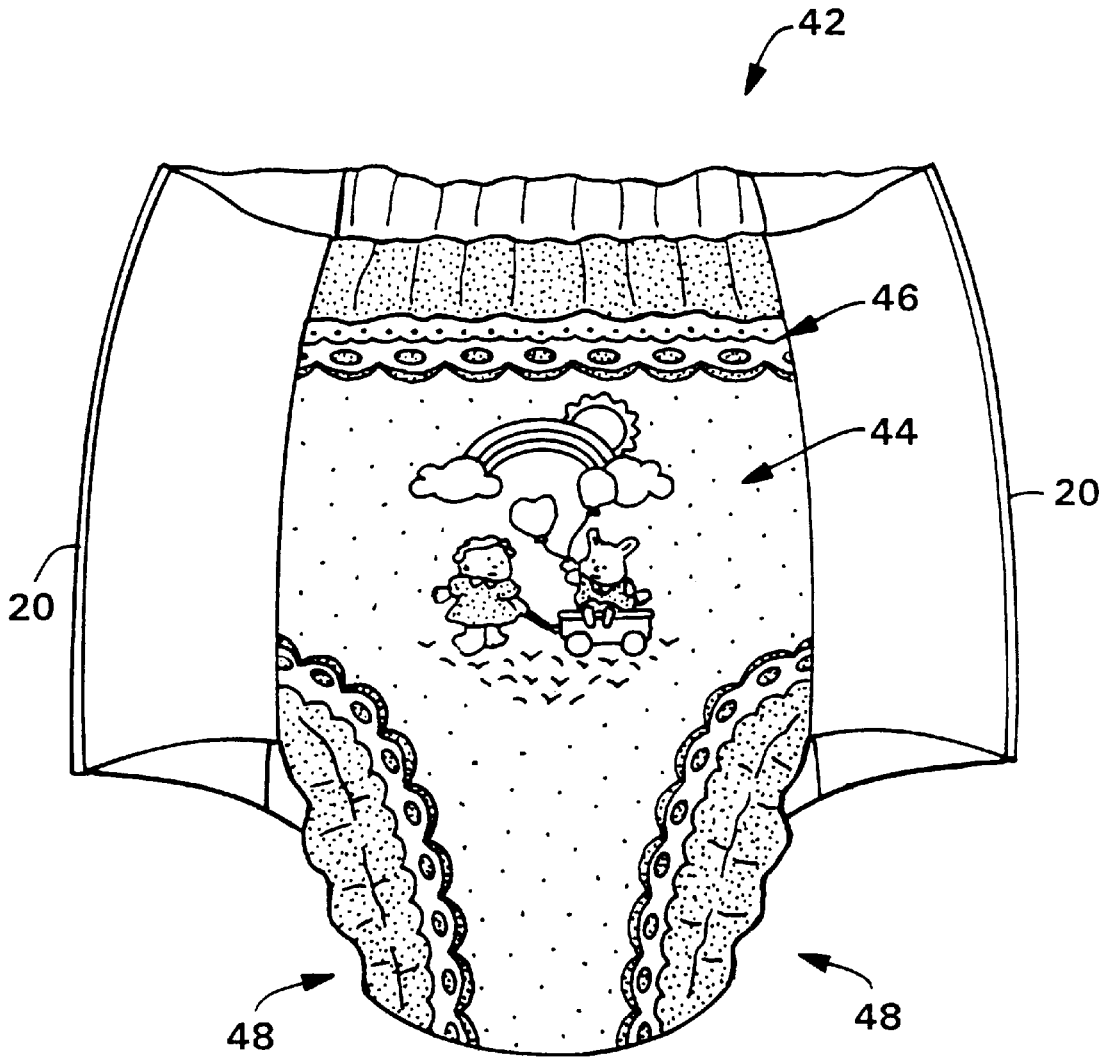
FIG. 2 illustrates a front view of another article having a graphic thereon.

FIGS. 1 and 2 illustrate a child's disposable absorbent training pant which is representative of a type of article to be packaged in a desired orientation relative to a packaging bag. The term "disposable" means that the training pant is designed to be used until soiled and then discarded, rather than being washed and reused. Examples of other suitable disposable absorbent articles that can be used with the flexible packaging bag of the present invention include, but are not limited to, disposable absorbent pants, diapers, feminine care products, incontinence products, disposable apparel, or the like. Hereafter, when used with reference to, by way of example, a disposable training pant, the term "component" can refer, but is not limited, to all or a segment of a designated selected region, such as edges, corners, sides or the like; structural members such as elastic strips, absorbent pads, elastic layers or panels, layers of material, or the like; or a graphic. The term "graphic" can refer, but is not limited, to an image, design, pattern, symbology, indicia, or the like.

A disposable absorbent article, such as the training pant illustrated in FIGS. 1 or 2, can have multiple appearance-related and/or function-related components. Examples of components that are appearance-related include, but are not limited to, graphics; the highlighting or emphasizing of leg and waist openings in order to make product shaping more evident or visible; the highlighting or emphasizing of areas of the article to simulate functional components such as elastic leg bands, elastic waistbands, simulated "fly openings" for boys, or ruffles for girls; the highlighting of areas of the product to change the appearance of the size of the product; selectively positioned wetness indicators; back labels or front labels; and selectively positioned written instructions at a desired location on the article.

Examples of functional components include, but are not limited to, waist elastics, leg elastics, areas of breathability, fluid repellent areas, fluid wettable areas, adhesives, coatings, encapsulated inks, chemically-sensitive materials, environmentally-sensitive materials, heat-sensitive materials, moisture-sensitive materials, perfumes, odor control agents, inks, fasteners, fluid storage areas, textured or embossed areas, or the like. Referring now to FIG. 1, there is illustrated a child's disposable training pant 10 generally comprising a front panel 12, a back panel 14, a crotch panel 16 interconnecting front and back panels 12, 14, and a pair of elastic side panels 18. Each elastic side panel 18 is formed from two separate elastic portions and are suitably joined together, such as by ultrasonic bonding, to form a nonrefastenable bonded side seam 20. Upon the construction of side seams 20, a waist opening 22 and leg openings 24 are formed. The side seams 20 may be constructed to be manually tearable in order to allow training pant 10 to be disassembled manually by the caregiver, so that it can be easily removed from the child after a bowel movement. A more detailed description of the construction and design of training pant 10 can be found in U.S. Pat. No. 4,940,464, the contents of which are incorporated by reference herein. One specific manner of supplying elastic side panels 18 is described in U.S. Pat. No. 5,224,405 and in U.S. Pat. No. 5,104,116, both of which are incorporated by reference herein. The provision of side seams 20 can be accomplished in the manner described in U.S. Pat. No. 5,046,272 which is incorporated by reference herein.

Training pant 10 further comprises a front waist elastic 26, suitably joined to front panel 12, a back waist elastic 28 suitably joined to back panel 14, leg elastics 30 suitably positioned in crotch panel 16, and an absorbent pad 32 positioned between a liquid impermeable outer cover or backsheet 34 and a liquid permeable liner or topsheet 36. A graphic 38 is selectively positioned on front panel 12, and as illustrated comprises a design of a simulated "fly opening" 40, typical of a male's underwear or pants, along with a rainbow, sun, clouds, and cars. The graphic 38 can be any type of desired pattern, artistic feature, or the like, and is positioned at a selected location.

FIG. 2 illustrates another training pant 42 that can be typically used for young girls. This training pant 40 includes a graphic 44 representative of the different types of appearance-related components that can be included in a disposable absorbent article. The graphic 44 includes simulated waist ruffles 46, simulated leg ruffles 48, along with a rainbow, sun, clouds, wagon, and balloon. Again, any suitable graphic can be utilized so as to convey an aesthetically and/or functionally pleasing appearance to the user and caregiver. The graphics 38, 44 can be designed to appeal particularly to a child, and can assist in encouraging and reinforcing the child's desire or interest in toilet training. This being the case, it is desirable to display, visually and accurately to the child or caregiver, the graphics 38, 44 when the training pants 10, 42 are packaged in this flexible packaging bag.

Figure 3:
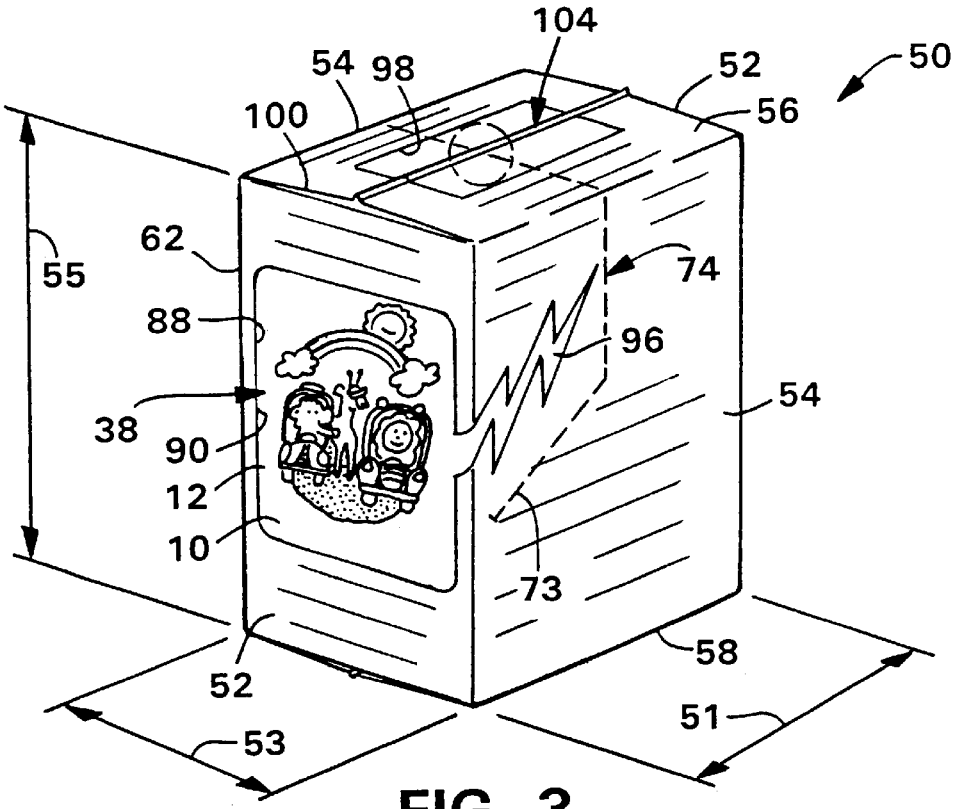
FIG. 3 illustrates a perspective view of one form of the present invention.
Figure 4:
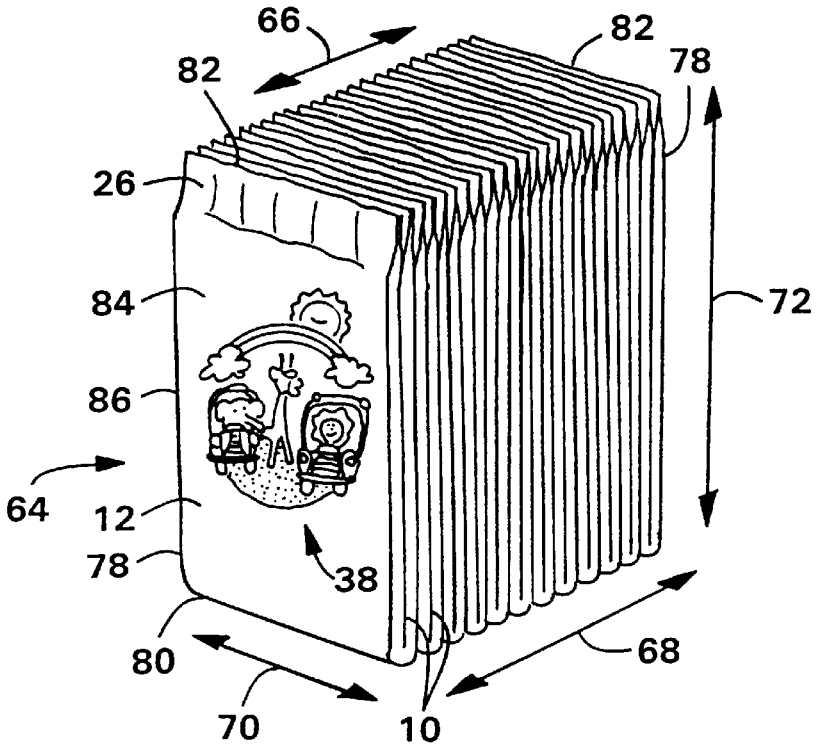
FIG. 4 illustrates a perspective view of a stack of articles.

Referring primarily to FIG. 3, there is illustrated a flexible packaging bag 50 having a polyhedral shape defining or forming a polyhedral enclosure. Specifically, bag 50 has a hexahedral shape that forms or defines a hexahedral enclosure having a bag length dimension 51, a bag width dimension 53, and a bag height dimension 55. Bag 50 is formed or defined by a pair of end walls 52, a pair of side walls 54, a top wall 56, and a bottom wall 58. Each of the walls has a periphery, such as periphery 62 for an end wall 52. The walls 52, 54, 56, 58 define an interior space 60 (FIG. 6) for containing a compressed stack 64 (FIG. 4) of articles, such as training pants 10. The term "compressed articles" or similar terminology will mean that the stack of articles, such as training pants 10 in FIG. 4, are compressed inwardly by a compression force at their front and back surfaces or panels, such as front panel 12 and back panel 14, in a direction parallel to stack direction 66 (FIG. 4), so as to decrease the length dimension 68 (FIG. 4) of the originally, uncompressed articles. The compressed stack 64 also includes a width dimension 70 and a height dimension 72. The term "compression packed" or similar terminology describes the state or condition of training pants 10 after they have been compressed and inserted into bag 50. The term "expansion force" or similar terminology refers to that generally equal force exerted by the compressed stack 64 in a direction generally opposite and parallel to the compression force and primarily against end walls 52. Naturally, all of the walls of bag 50 experience some degree of tension.

Bag 50 may be composed of different materials, or may be composed of substantially the same type of material. Typically, the material is a polymer film which is sufficiently flexible to assume a desired, generally hexahedral shape when bag 50 is filled with training pants 10. In addition, the material should have sufficient strength to hold and contain the training pants 10, or other articles, without breaking and without excessive bulging or stretching of the film material. In one specific embodiment, the film material may be composed of a polyethylene film or film laminate having a thickness of about 2.25 mils. Other examples include a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like. A desired range of thickness is between about 1.5 mils to about 3.0 mils. A more desired range of thickness is between about 1.75 mils to about 2.5 mils. Naturally, the dimensions of bag 50 will depend upon the types of articles to be contained therein as well as the desired or aesthetically preferred shape. A suitable bag, and its method of construction, is illustrated and described in U.S. Pat. No. 5,282,687, the contents of which are incorporated by reference herein.

Figure 6:
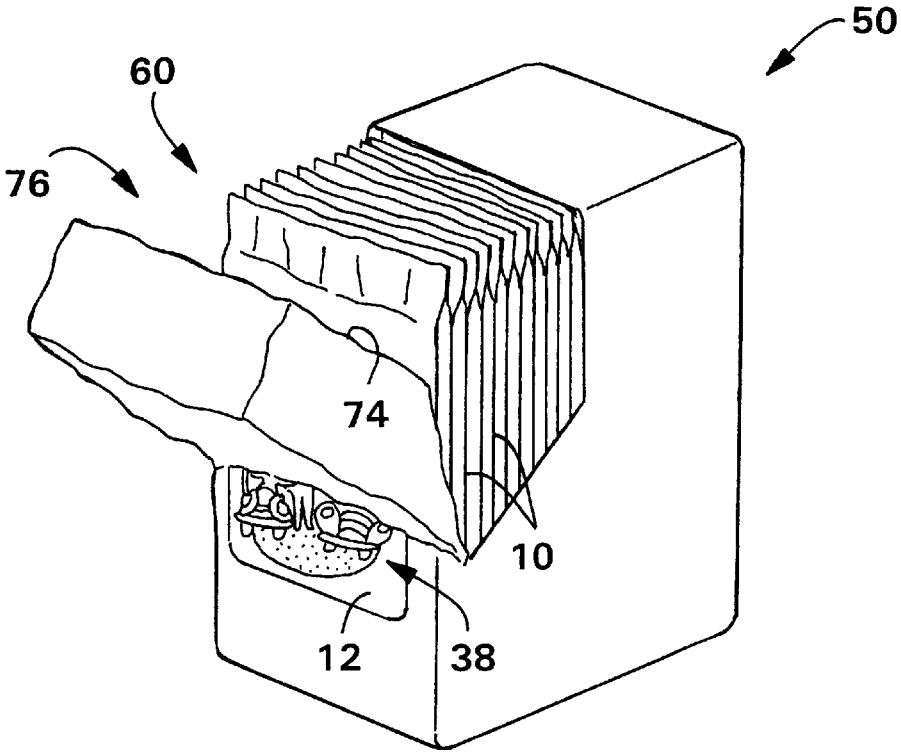
FIG. 6 illustrates a flexible packaging bag that has been opened to expose the interior space and the articles contained therein.

Continuing to refer to FIG. 3, bag 50 includes top gussets 100 (only one of which is illustrated in FIG. 3) integrally formed with walls 52, 54, and a mechanism or a means for accessing the interior space 60 (FIG. 6) for dispensing the training pants 10 therefrom. The mechanism or means for accessing can be, by way of example, a frangible line 74 that is easily broken, and which can be disposed or manufactured in any design, pattern, or form at any desired position or location on bag 50 during the manufacture of bag 50. As illustrated in FIG. 3, frangible line 74 is partially located in one side wall 54, continues upwardly and across top wall 56, and then downwardly along the opposite side wall 54 in the same manner as in the other side wall 54. This is also illustrated in FIG. 6 where frangible line 74 has been torn in order to provide an opening 76 for accessing and dispensing training pants 10. Frangible line 74 may, for example, be provided by partially cutting or otherwise thinning through the thickness of the bag material in a predetermined pattern, providing a selected pattern of perforations along the desired sections or walls of the bag, providing a desired pattern of stress-fatigue weakening along a desired line of the bag, or the like. As illustrated, frangible line 74 is provided by a line of perforations in which there can be approximately 2–10 perforations per lineal inch. Both the manufacturing and packaging of bag 50, and the provision of a frangible line 74, can be accomplished in any suitable manner well known in the art.

Figure 5:
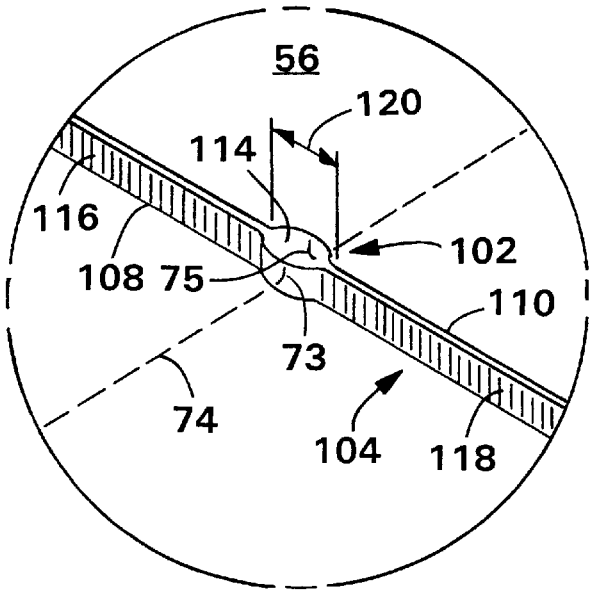
FIG. 5 illustrates an enlarged, fragmentary, broken-away view of the circled area in FIG. 3.

Referring now to FIG. 5, it shows the circled portion of FIG. 3 in a slightly rotated manner for ease of description, and illustrates portions of top wall 56, frangible line 74, and a seal 104. As illustrated, frangible line 74 and seal 104 intersect, by way of example, at top wall 56. Frangible line 74, as illustrated in FIG. 3, traverses the bag width dimension 53 and is desirably perpendicular to seal 104. The seal 104 comprises a first lengthwise-extending flange member 108 and a second lengthwise-extending flange member 110, which in this embodiment are formed by top wall 56. In the manufacturing process, after the compressed stack of articles 64 (FIG. 4) has been inserted into bag 50, as earlier described, walls 52, 54, are appropriately folded to form gussets 100 and the lengthwise-extending flange members 108, 110. The flange members 108, 110 are turned outwardly, as illustrated in FIG. 5, in order to be appropriately joined together. The term "joining" when used in describing the relationship between two or more elements means that the elements can be connected together in any suitable manner, such as by ultrasonic bonding, heat bonding, adhesive bonding, or the like; the elements can be joined directly together, or may have one or more elements interposed between them, all of which are connected together. The joining together of flange members 108, 110 forms at least one seal area, and desirably forms two seal areas 116, 118 having therebetween a weakened zone 102. It is at this weakened zone 102 that frangible line 74 crosses or intersects seal 104. Weakened zone 102 is designed and constructed, so that it will easily tear by hand, such as, by way of example only, in the same or similar manner as frangible line 74. Thus, when possible, it may be desired to form or manufacture weakened zone 102 in the same manner as frangible line 74, such as, by way of example only, thinning, perforating, cutting, or the like. In addition, weakened zone 102 also can comprise a void area, i.e., an area in which flange members 108, 110 are not joined together. Thus, a void area 114 (FIG. 5) represents that portion of the mutually facing surfaces of flange members 108, 110 that are not joined together, and is that area over or through which frangible line 74 crosses or intersects. The width 120 of weakened zone 102, or void area 114, generally is dependent upon the accuracy in aligning flange members 108, 110 and respective ends 73, 75 of frangible line 74. Generally speaking, width 120 is desirably less than about 10 millimeters, and more desirable less than about 5 millimeters.

Hereafter, the description of the present invention will be made with reference to void area 114, but it is to be understood that void area 114 is only one example of a weakened zone 102, as described above. The crossing or intersecting of frangible line 74 and void area 114 is important to the present invention in permitting bag 50 to be opened easily, as well as permitting easy removal of the compressed articles therefrom. If there was no void area 114, it would be difficult, if not impossible, for the user to easily separate frangible line 74 at the intersection with seal 104, since the seal generally results in a hard, stiff mass of polymeric material. With void area 114 in seal 104, there is no joining of flange members 108, 110, and the separation of frangible line 74 is easily accomplished across top wall 56, since the only force required is that of tearing frangible line 74. Even in those modifications of weakened zone 102 in which a design other than a void area 114 is provided, e.g., perforations similar to frangible line 74, the force required to tear through weakened zone 102 is such that it can be easily torn. Although this description is with reference to frangible line 74 intersecting seal 104 in top wall 56, a frangible line and a seal may intersect elsewhere depending upon the design, manufacture, and packaging of a particular bag.

Referring now primarily to FIG. 4, each training pant 10 has been folded such that the elastic side panels 18 (FIG. 1) are inwardly disposed between front panel 12 and back panel 14. As illustrated in FIG. 4, each training pant 10 generally defines opposing side edges 78, a bottom edge 80, a top edge 82, opposing face surfaces 84 (only one of which is illustrated in FIG. 4), and a periphery 86. When the pants are compression packed in bag 50, the bottom edges 80 (as viewed in FIG. 4) of training pants 10 contact bottom wall 58, the top edges 82 of the training pants 10 contact the top wall 56, the side edges 78 of the training pants 10 contact the bag side walls 54, and the outermost face surface 84 of the end training pants 10 contact end walls 52. Note that the top edge 82 of a training pant 10 in FIG. 4 is associated with waist opening 22 (FIG. 1).

Referring primarily to FIG. 3, bag 50 further includes a window 88 disposed or positioned within a portion of end wall 52. Window 88 includes a window periphery 90 that has a shape that is substantially similar to the periphery of end wall 52. Window 88 at least substantially frames a component of the training pants 10 contained within bag 50. In FIG. 3, the component framed by window 88 is a portion or segment of graphic 38, which is visually perceivable through window 88. Training pant 10 also could have another graphic on back panel 14, and in this case, it may be desirable to have that graphic on back panel 14 visually perceivable through the end wall 52 opposite from the end wall 52 that has window 88 framing graphic 38. In this case, the opposite end wall, i.e., that end wall not visible in FIG. 3, would also have a window.

Depending upon the type of articles to be contained in bag 50, and the components of those articles, it may be desirable to have a window in a different wall from end walls 52. For example, should a stack of articles be packaged in a different orientation in bag 50, then one of the side walls 54, or the top wall 56 or the bottom wall 58, can have a window to permit a component to be visually perceived therethrough. In any event, the desire to have graphic 38 visually perceived though window 88, and in a desired orientation relative to bag 50, is just one example of an article that needs to be packaged in a bag in a desired orientation.

In referring to window 88 framing a component, such as graphic 38, the term "framing", "substantially framing", or variations thereof, means that the window periphery surrounds or encompasses all or at least a portion of the component for visual display. Within the context of this description, a component is visually perceivable if it is clear or substantially clear to the person viewing it. The term "clear" refers to the material capability of transmitting light so that the component, or a portion thereof, can be seen as clearly as if there were no intervening material between the component and the individual. For example, a material is "clear", "substantially clear", or the like when light readily passes through, such that written or printed indicia, graphics or the like located opposite the clear material can be viewed by the naked eye. A material will generally be considered to be "clear", "substantially clear", or the like when it has a light transmission greater than about 50 percent, desirably greater than about 80 percent, and more desirably greater than about 90 percent. The light transmission of a material can be suitably determined by BYK Gardener as set forth in ASTM-D 2244-85.

Because of the need to have a graphic 38, 42 properly oriented in bag 50 relative to window 88 for desired display and/or viewing purposes, the manufacturing and packaging of a bag 50 with training pants 10 can require the bag to be oriented such that the seal is located in a top wall with the frangible line. Due to this particular manufacturing and packaging requirement, the seal may intersect the frangible line, thereby causing the problems described earlier with tearing a frangible line at its intersection with a seal. This particular problem is solved by the present invention.

A potential problem with arranging bags 50 on a shelf for retail purposes is that it may not be practical to orient the bags 50 so that windows 88 are visible. In this instance, for example, bags 50 might be oriented on the shelf space such that one of the side walls 54 is visible. To overcome this problem and in order to draw attention to end wall 52 and window 88, a visual cue 96 (FIG. 3) is disposed or arranged in at least one of the side walls 54 of bag 50. Visual cue 96 can be a clear or substantially clear portion of a wall, and as illustrated in FIG. 3, has the shape of, by way of example, a lightening bolt. It should be noted that for purposes of explanation and clarity, visual cue 96 does not show the side edges 78 (FIG. 4) of the individual training pants 10 contained therein. A purpose of visual cue 96 is to draw the attention of a user to the end wall 52, so that a component, such as a graphic 38, of an article, such as a training pant 10, can be visually perceived. Visual cue 96 also can serve as a product-remaining indicator or gauge, so that a caregiver can easily determine the number of pants 10 remaining in bag 50.

Visual cue 96 may or may not be continuous with window 88. In other words, as illustrated in FIG. 3, visual cue 96 and window 88 form a closed loop pattern or periphery. However, it may be desirable for manufacturing, printing, or packaging purposes to have visual cue 96 and window 88 provided as separate areas of visibility. In the latter case, visual cue 96 still serves to draw the attention to window 88 and graphic 38. Thus, visual cue 96 is visually associated with window 88 to draw attention of the purchaser, user, or the like, to window 88 and graphic 38. The visual cue 96 can be provided in the material of which bag 50 is made in any suitable manner well known in the art.

Although visual cue 96 has been described as a clear, or substantially clear, portion of a wall, it can be structure separate from a wall, and need not be clear or substantially clear. Again, a purpose of visual cue 96 is to draw the attention of a user or other individual to window 88. Thus, depending on the design, configuration or the like, of a bag 50, visual cue 96 can be provided with any desired design, configuration, or the like suitable to its purpose.

Continuing to refer primarily to FIG. 3, bag 50 may further include an accessory window 98 in top wall 56. Accessory window 98 permits at least a portion of the contents therein, such as training pants 10, to be visually perceived. Accessory window 98 can be positioned or manufactured in any of the walls of bag 50, but it is desired that it is in top wall 56, so that the user can determine the number of training pants 10 remaining in bag 50. As with window 88, accessory window 98 can be either clear or substantially clear.

With reference primarily to FIGS. 3 and 6, bag 50 is opened by breaking frangible line 74 to gain access via opening 76 to training pants 10. Typically, the separation of frangible line 74 is initiated by breaking a portion thereof, and then propagating the break or tear along frangible line 74 through top wall 56 and those portions of side walls 54 into which frangible line 74 is manufactured. By thus breaking frangible line 74, the user can insert a finger or thumb through opening 76 in order to gain access to training pants 10. Thereafter, the user can grasp the top of a training pant 10 and pull it out of bag 50, while the remaining training pants 10 are maintained within the confines or interior space 60. The frangible line 74 runs generally perpendicular to seal 104 in top wall 56, and is positioned in top wall 56, as measured from the end wall 52 having window 88, a distance that is generally at least about 10% of bag length dimension 51. Frangible line 74 then runs down side walls 54 a generally vertical distance, as viewed in FIG. 3, that is at least about 20% of bag height dimension 55. Thereafter, frangible line 74 runs angularly, between about 30 degrees to about 60 degrees of height dimension 55, toward end wall 52 and terminates short of end wall 52, i.e., no portion of frangible line 74 enters end wall 52. Thus configured, frangible line 74 provides an opening 60 that permits easy removal of a training pant 10, yet helps to keep the remaining training pants 10 in bag 50, while also maintaining the general shape of bag 50.

While this invention has been described as having a preferred embodiment, it will be understood that it is capable of further modifications. It is therefore intended to cover any variations, equivalents, uses, or adaptations of the invention following the general principles thereof, and including such departures from the present disclosure as come or may come within known or customary practice in the art to which this invention pertains and falls within the limits of the appended claims.

What is claimed:

1. A flexible polymer packaging bag, comprising:

a pair of side walls, a pair of end walls, a top wall, and a bottom wall; said walls forming an interior space, said walls being composed of a polymer material having a selected thickness, a stack of articles contained in said interior space and having a stack direction, each one of said articles comprising a front panel and a back panel, a graphic on one of said panels of each said article, a window in one of said walls and having a periphery, said periphery substantially framing at least a portion of said graphic such that at least said portion of said graphic is visually perceivable through said window, a seal in said top wall, said seal comprising a pair of flange members being joined together at selected areas thereof to form at least one seal area and at least one void area, and a frangible line in said top wall and intersecting said void area.

2. A flexible polymer packaging bag, comprising:

a pair of side walls, a pair of end walls, a top wall, and a bottom wall, said walls forming an interior space, said walls being composed of a polymer material having a selected thickness, a stack of articles contained in said interior space and having a stack direction, each one of said articles comprising a front panel and a back panel, a graphic on one of said panels of each said article, a window in one of said walls and having a periphery, said periphery substantially framing at least a portion of said graphic, a seal in said top wall, said seal comprising a pair of flange members being joined together at selected areas thereof to form at least one seal area and at least one void area, and a frangible line in said top wall and intersecting said void area, wherein said frangible line extends across said top wall and at least partially into each of said side walls.

3. The bag of claim 2 wherein said frangible line extends across said top wall in a direction generally perpendicular to said stack direction.

4. The bag of claim 3 wherein said void area has a width of about 10 millimeters or less.

5. The bag of claim 4 wherein said thickness of said polymer material is between about 1.5 mils to about 3.0 mils.

6. A flexible polymer packaging bag, comprising:

a pair of side walls, a pair of end walls, a top wall, and a bottom wall; said walls forming an interior space, said walls being composed of a polymer material having a selected thickness, a stack of articles contained in said interior space and having a stack direction, each one of said articles comprising a front panel and a back panel, a graphic on one of said panels of each said article, a window in one of said walls and having a periphery, said periphery substantially framing at least a portion of said graphic, a seal in said top wall, said seal comprising a pair of flange members being joined together at selected areas thereof to form at least one seal area and at least one void area, a frangible line in said top wall and intersecting said void area, and a visual cue on another of said walls for drawing attention to said window.

7. The bag of claim 6 wherein said visual cue is at least substantially clear.

* * * * *